US011015851B2

(12) United States Patent
Tanaka

(10) Patent No.: US 11,015,851 B2
(45) Date of Patent: May 25, 2021

(54) REFRIGERATION CYCLE DEVICE

(71) Applicant: Mitsubishi Electric Corporation, Tokyo (JP)

(72) Inventor: Chitose Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/605,401

(22) PCT Filed: Jul. 7, 2017

(86) PCT No.: PCT/JP2017/024969
§ 371 (c)(1),
(2) Date: Oct. 15, 2019

(87) PCT Pub. No.: WO2019/008744
PCT Pub. Date: Jan. 10, 2019

(65) Prior Publication Data

US 2020/0124328 A1 Apr. 23, 2020

(51) Int. Cl.
*F25B 47/02* (2006.01)
*F25B 13/00* (2006.01)

(52) U.S. Cl.
CPC ..... *F25B 47/02* (2013.01); *F25B 13/00* (2013.01)

(58) Field of Classification Search
CPC ..... F25B 1/00; F25B 47/02
(Continued)

(56) References Cited

U.S. PATENT DOCUMENTS 5,651,261 A * 7/1997 Nakajima ..... F25D 21/002 62/155
2005/0011206 A1* 1/2005 Luo ..... F25B 47/025 62/160

(Continued)

FOREIGN PATENT DOCUMENTS

JP S61-036659 A 2/1986
JP S62-125271 A 6/1987

(Continued)

OTHER PUBLICATIONS

Extended European Search Report dated Jun. 2, 2020 issued in the counterpart application file with EPO No. 17917125.1.

(Continued)

*Primary Examiner* — Henry T Crenshaw
(74) *Attorney, Agent, or Firm* — Posz Law Group, PLC

(57) ABSTRACT

A refrigeration cycle device performs a heating operation and a defrosting operation. A refrigerant circulates in opposite directions in the defrosting operation and the heating operation. The refrigeration cycle device includes a compressor, a first heat exchanger and a second heat exchanger, a decompressor, and a flow path switch. In the heating operation, the refrigerant circulates in the order of the compressor, the first heat exchanger, the decompressor, and the second heat exchanger. In the defrosting operation, the refrigerant circulates in the order of the compressor, the second heat exchanger, the decompressor, and the first heat exchanger. The defrosting operation includes a first mode and a second mode. The opening of the decompressor is greater in the first mode than in the heating operation. The opening of the decompressor is less in the second mode than in the first mode.

4 Claims, 8 Drawing Sheets

(58) Field of Classification Search
USPC ..... 62/151
See application file for complete search history.

(56) References Cited

U.S. PATENT DOCUMENTS

| | | | | |
|---|---|---|---|---|
| 2006/0272345 | A1* | 12/2006 | Ueno | F25B 13/00 62/278 |
| 2007/0033955 | A1* | 2/2007 | Luo | F25B 47/025 62/150 |
| 2013/0091882 | A1* | 4/2013 | Cho | F25B 13/00 62/156 |
| 2013/0104576 | A1* | 5/2013 | Lee | F25B 47/02 62/80 |

FOREIGN PATENT DOCUMENTS

| | | | |
|---|---|---|---|
| JP | H02-230058 | A | 9/1990 |
| JP | 02-230058 | * | 2/1998 |
| JP | 2010-101570 | A | 5/2010 |
| JP | 2016-080330 | A | 5/2016 |

OTHER PUBLICATIONS

International Search Report of the International Searching Authority dated Aug. 29, 2017 for the corresponding International application No. PCT/JP2017/024969 (and English translation).
Office Action dated Sep. 23, 2020 issued on corresponding JP application No. 2019-528303 (and English translation).

* cited by examiner

REFRIGERATION CYCLE DEVICE

TECHNICAL FIELD

The present invention relates to a refrigeration cycle device which switches directions of circulation of a refrigerant and causes a heat exchanger, which functions as an evaporator in a heating operation, to function as a condenser in a defrosting operation to defrost the heat exchanger.

CROSS REFERENCE TO RELATED APPLICATION

This application is a U.S. national stage application of PCT/JP2017/024969 filed on Jul. 7, 2017, the contents of which are incorporated herein by reference.

BACKGROUND ART

Conventionally, refrigeration cycle devices are known which switch directions of circulation of a refrigerant and cause a heat exchanger, which functions as an evaporator in a heating operation, to function as a condenser in a defrosting operation to defrost the heat exchanger. For example, Japanese Patent Laying-Open No. S61-36659 (PTL 1) discloses a heat pump air conditioner which reduces flow path resistance of an expansion means in a defrosting operation less than in a typical heating operation, thereby allowing a reduction in time required for the defrosting operation.

CITATION LIST

Patent Literature

PTL 1: Japanese Patent Laying-Open No. S61-36659

SUMMARY OF INVENTION

Technical Problem

An amount of refrigerant (a circulation volume of the refrigerant) that passes, per unit time, through the heat exchanger (the heat exchanger that functions as the evaporator in the heating operation) to be defrosted is increased by reducing the flow path resistance of the expansion means in the defrosting operation less than in the typical heating operation, as the heat pump air conditioner disclosed in Japanese Patent Laying-Open No. S61-36659 (PTL 1). Consequently, the quantity of heat per unit time increases, which is transferred from a component (e.g., a piping member or a compressor) of the refrigeration cycle device via the refrigerant to the heat exchanger to be defrosted. As a result, the rate of melting of the frost formed on the heat exchanger increases.

If the refrigerant can barely recover heat from the component of the refrigeration cycle device (if the heat capacity of the component is almost used up) prior to the completion of defrosting of the heat exchanger, there is almost no quantity of heat that is to be transferred via the refrigerant to the heat exchanger to be defrosted, which slows down the rate of melting of the frost formed on the heat exchanger. This results in delay in completion of the defrosting operation.

The present invention is made to solve the problem as mentioned above, and an object of the present invention is to reduce the time required to defrost the refrigeration cycle device.

Solution to Problem

A refrigeration cycle device according to the present invention performs a heating operation and a defrosting operation. A refrigerant circulates in opposite directions in the defrosting operation and the heating operation. The refrigeration cycle device includes a compressor, a first beat exchanger and a second heat exchanger, a decompressor, and a flow path switch. The flow path switch switches the directions of circulation of the refrigerant. In the heating operation, the refrigerant circulates in the order of the compressor, the first heat exchanger, the decompressor, and the second heat exchanger. In the defrosting operation, the refrigerant circulates in the order of the compressor, the second heat exchanger, the decompressor, and the first heat exchanger. The defrosting operation includes a first mode and a second mode. The opening of the decompressor is greater in the first mode than in the heating operation. The opening of the decompressor is less in the second mode than in the first mode.

The defrosting operation of the refrigeration cycle device according to the present invention includes a first mode in which the opening of the decompressor is greater than in the heating operation, and a second mode in which the opening of the decompressor is less than in the first mode. In the first mode, the heat exchanger is defrosted using mainly the quantity of heat stored in a component of the refrigeration cycle device. In the second mode, energy (compressor input) applied to the refrigerant by the compressor increases greater than in the first mode. Even if the quantity of heat required to defrost the heat exchanger is insufficient in the first mode, the quantity of heat required to defrost the heat exchanger can be compensated for in the second mode. Consequently, the rate of melting of the frost formed on the heat exchanger to be defrosted, can be inhibited from decreasing.

Advantageous Effects of Invention

According to the refrigeration cycle device of the present invention, the time required to defrost the heat exchanger can be reduced.

DESCRIPTION OF EMBODIMENTS

Hereinafter, an embodiment according to the present invention will be described, with reference to the accompanying drawings. Note that the same reference signs are used to refer to the same or like parts, and the description thereof will in principle not be repeated.

Figure 1:
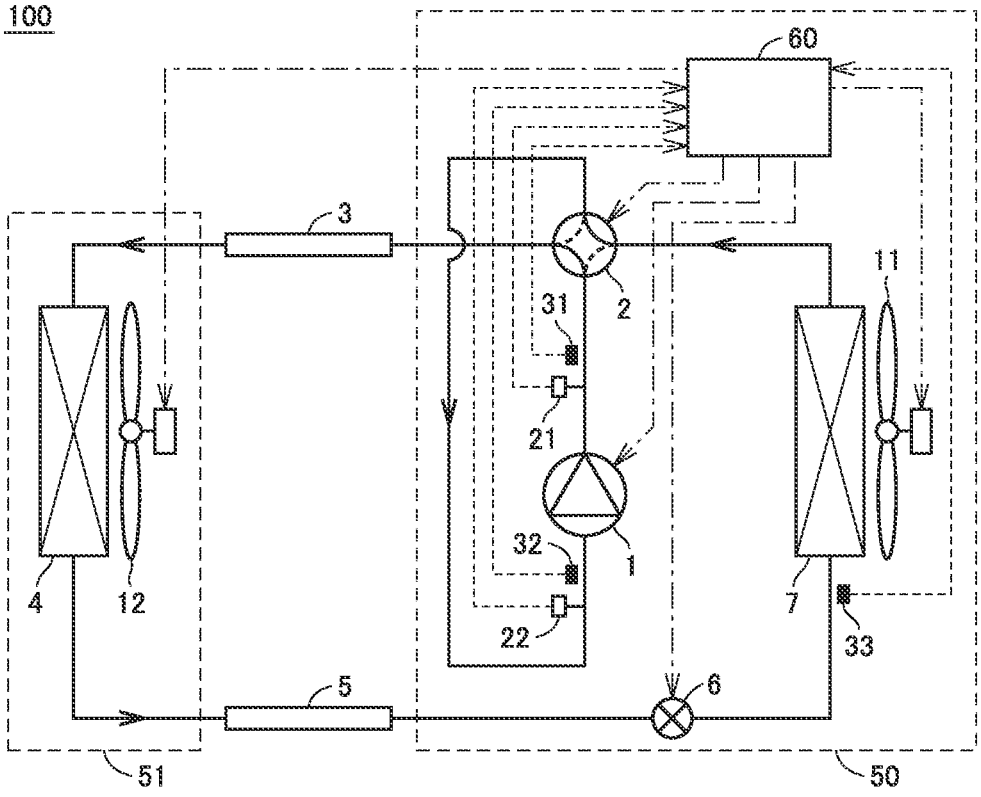
FIG. 1 is a diagram showing a functional configuration of a refrigeration cycle device according to an embodiment.

FIG. 1 is a diagram showing a functional configuration of a refrigeration cycle device 100 according to an embodiment. Refrigeration cycle device 100 performs a heating operation, a cooling operation, and a defrosting operation. The defrosting operation includes a first mode and a second mode. FIG. 1 shows a flow of a refrigerant in the heating operation.

As shown in FIG. 1, refrigeration cycle device 100 includes an outdoor unit 50 and an indoor unit 51. Outdoor unit 50 and indoor unit 51 are connected to each other by connecting pipes 3 and 5. Outdoor unit 50 includes a compressor 1, a four-way valve 2, a decompressor 6 which includes an expansion valve, an outdoor heat exchanger 7, an outdoor fan 11, and a controller 60. Indoor unit 51 includes an indoor heat exchanger 4 and an indoor fan 12.

Outdoor fan 11 is arranged to be close to outdoor heat exchanger 7. Indoor fan 12 is arranged to be close to indoor heat exchanger 4.

Controller 60 controls the drive frequency of compressor 1. Controller 60 switches four-way valve 2. Controller 60 controls the opening of decompressor 6. Controller 60 controls an air delivery rate of outdoor fan 11 per unit time, and an air delivery rate of indoor fan 12 per unit time.

A pressure sensor 21 and a thermistor 31 are attached to a discharge piping of compressor 1. A pressure sensor 22 and a thermistor 32 are attached to a drawing-in piping of compressor 1. Controller 60 uses pressure sensors 21, 22 to measure a pressure of a refrigerant. Controller 60 uses thermistors 31, 32 to measure a piping temperature corresponding to a temperature of the refrigerant.

A thermistor 33 is attached to a piping that is connecting decompressor 6 and outdoor heat exchanger 7. Controller 60 measures a piping temperature corresponding to a temperature of the refrigerant leaving the outdoor heat exchanger 7.

In the heating operation, controller 60 controls four-way valve 2 to bring the outlet of compressor 1 and a connecting pipe 3 into communication, and outdoor heat exchanger 7 and the inlet of compressor 1 into communication. A gaseous refrigerant (a gas refrigerant), which has been adiabatic compressed by compressor 1 and become high temperature and high pressure, passes through four-way valve 2 into indoor heat exchanger 4 via connecting pipe 3. Indoor heat exchanger 4 functions as a condenser in the heating operation. The high-temperature, high-pressure gas refrigerant dissipates heat to indoor air introduced into indoor heat exchanger 4 by indoor fan 12, and condenses into a high pressure liquid refrigerant (a liquid refrigerant).

The high pressure liquid refrigerant passes through decompressor 6 via connecting pipe 5, thereby expanding into a low-temperature, low-pressure refrigerant (wet steam) in a two-phase gas/liquid state, and the wet steam flows into outdoor heat exchanger 7. Outdoor heat exchanger 7 functions as an evaporator in the heating operation. The low-temperature, low-pressure wet steam absorbs heat from outdoor air introduced into outdoor heat exchanger 7 by outdoor fan 11, and evaporates into a low pressure gas refrigerant. The low pressure gas refrigerant is then drawn into compressor 1 via four-way valve 2, and circulates through refrigeration cycle device 100 in the same manner described above.

Figure 2:
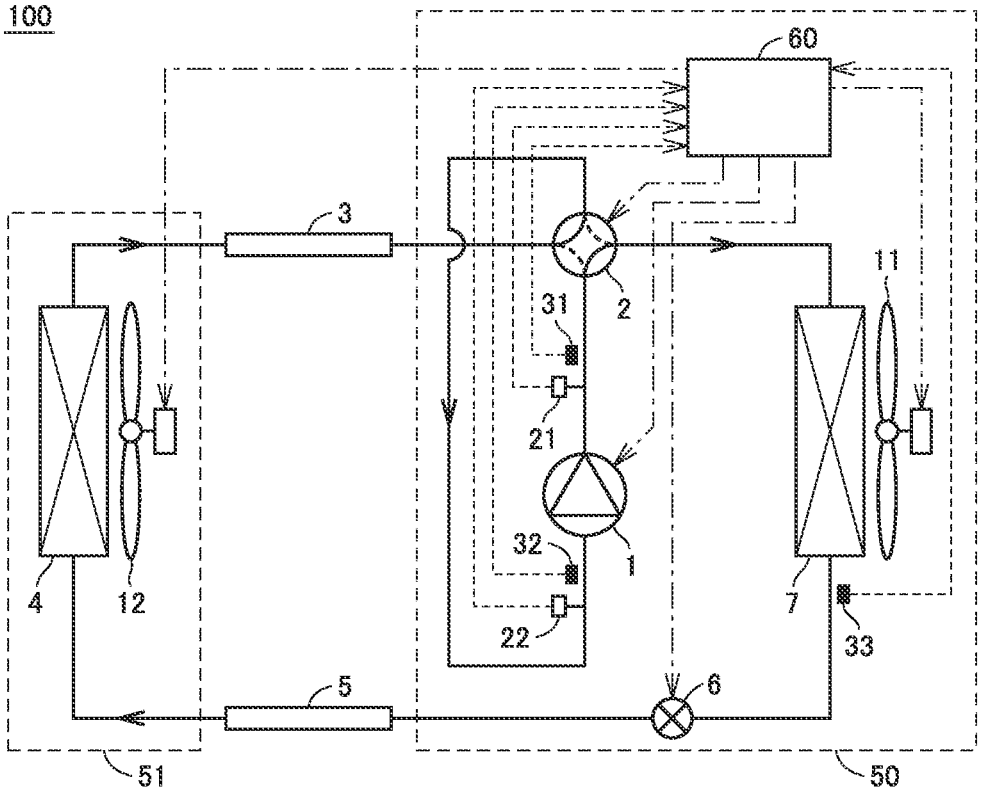
FIG. 2 is a diagram showing the functional configuration of the refrigeration cycle device according to the embodiment, together with flows of a refrigerant in a cooling operation and a defrosting operation.

FIG. 2 is a diagram showing the functional configuration of refrigeration cycle device 100 according to the embodiment, together with flows of refrigerants in the cooling operation and the defrosting operation. As shown in FIG. 2, in the cooling operation, controller 60 switches four-way valve 2 to bring the outlet of compressor 1 and outdoor heat exchanger 7 into communication, and connecting pipe 3 and the inlet of compressor 1 into communication. The gas refrigerant, which is high temperature and high pressure by being compressed by compressor 1, passes through four-way valve 2 and flows into outdoor heat exchanger 7. Outdoor heat exchanger 7 functions as a condenser in the cooling operation and the defrosting operation. The high-temperature, high-pressure gas refrigerant dissipates heat to outdoor air introduced into outdoor heat exchanger 7 by outdoor fan 11, and condenses into a high pressure liquid refrigerant.

The high pressure liquid refrigerant passes through decompressor 6, thereby expanding into low-temperature, low-pressure wet steam, and the wet steam flows into indoor heat exchanger 4 via connecting pipe 5. Indoor heat exchanger 4 functions as an evaporator in the cooling operation and the defrosting operation. The low-temperature, low-pressure wet steam absorbs heat from indoor air introduced into indoor heat exchanger 4 by indoor fan 12, and evaporates into a low pressure gas refrigerant. The low pressure gas refrigerant then passes through four-way valve 2 via connecting pipe 3 and is drawn into compressor 1, and circulates through refrigeration cycle device 100 in the same manner described above.

In the heating operation of a refrigeration cycle, as the outside air temperature decreases less than a certain temperature (e.g., 7 degrees Celsius), the temperature of outdoor heat exchanger 7, functioning as the evaporator, decreases less than zero degree Celsius, resulting in formation of frost on outdoor heat exchanger 7. As a result, an air duct of outdoor fan 11 is blocked with the frost and the heating capacity of refrigeration cycle device 100 decreases. The defrosting operation needs to be performed regularly to melt the frost formed on outdoor heat exchanger 7.

In the heating operation, the defrosting operation is initiated if defrost start conditions are met. The defrost start conditions may be any insofar as they indicate that the frost formed on the fins of outdoor heat exchanger 7 has grown to an extent that can be resistant to heat transfer or ventilation. Examples of the defrost start conditions include the pressure measured by pressure sensor 22 (the pressure of the refrigerant drawn into compressor 1) as being less than or equal to a reference pressure, and the temperature measured by thermistor 32 (the temperature of the refrigerant drawn into compressor 1) as being less than or equal to a reference temperature.

In the defrosting operation, controller 60 stops outdoor fan 11 and indoor fan 12, switches four-way valve 2 to reverse the direction of circulation of the refrigerant, and operate compressor 1. A high-temperature, high-pressure gas refrigerant, discharged from compressor 1, is allowed to flow into outdoor heat exchanger 7, thereby melting frost or ice formed on the fins of outdoor heat exchanger 7. A refrigerant that leaves the outdoor heat exchanger 7 is a liquid refrigerant having a temperature of about zero degree Celsius, and the refrigerant passes through decompressor 6 thereby expanding into low-temperature, low-pressure wet steam.

In the heating operation, temperatures of connecting pipe 5, indoor heat exchanger 4, and connecting pipe 3 are, generally, greater than or equal to 40 degrees Celsius, and up to around 100 degrees Celsius. The low-pressure, low-temperature wet steam, resulting from the refrigerant leaving the outdoor heat exchanger 7, passing through decompressor 6, and expanding during the defrosting operation, absorbs heat from the piping member and evaporates into a low pressure gas refrigerant on the way through indoor heat exchanger 4 via connecting pipe 5 to connecting pipe 3. The low pressure gas refrigerant is then drawn into compressor 1 via four-way valve 2, and circulates around refrigeration cycle device 100 in the same manner described above. In the defrosting operation, the quantity of heat applied to the refrigerant by compressor 1 and the quantity of heat of the piping member are used as primary heat sources to melt the frost formed on outdoor heat exchanger 7.

As the defrosting operation continues, the temperatures of connecting pipe 5, indoor heat exchanger 4, and connecting pipe 3 decrease, which prevents the refrigerant circulating around refrigeration cycle device 100 from recovering the quantity of heat from the piping member. Due to this, the refrigerant that passes through four-way valve 2 and is drawn into compressor 1 becomes low-temperature wet steam.

Even if almost all the heat capacity of the piping member has been used up, the quantity of heat required to defrost outdoor heat exchanger 7 can be compensated for by the quantity of heat of compressor 1 and the quantity of heat applied to the refrigerant by compressor 1. For example, if compressor 1 is a high-pressure shell compressor, the temperature of compressor 1 in the heating operation is around 100 degrees Celsius. Thus, the refrigerant extracts heat from compressor 1 and evaporates if wet steam flows into compressor 1 in the defrosting operation.

In the defrosting operation, the quantities of heat stored in the piping member or compressor 1 is greater than the quantity of heat applied to the refrigerant by compressor 1 in terms of an amount that can be used as the heat source for defrosting outdoor heat exchanger 7. Consequently, the time required to defrost outdoor heat exchanger 7 can be reduced by more quickly recovering the quantity of heat of the piping member or the quantity of heat of compressor 1. In order to quickly recover the quantity of heat, the circulation volume of the refrigerant needs to be increased. The circulation volume of the refrigerant can be increased by increasing the opening of decompressor 6 greater than in the heating operation. The quantity of heat can be recovered in the quickest possible way by maximizing the circulation volume of the refrigerant, and it is thus desirable that decompressor 6 is fully opened.

If decompressor 6 has a configuration of multiple on-off valves connected in parallel, rather than a single decompressor, it is desirable that all the multiple on-off valves are fully opened. Pressure loss in decompressor 6 is reduced by reducing the flow path resistance of decompressor 6, thereby allowing for an increased density of the refrigerant drawn into compressor 1. As a result, an increased circulation volume of the refrigerant is achieved. Thus, in the defrosting operation according to the embodiment, the first mode is performed in which the opening of decompressor 6 is greater than in the heating operation. In the first mode, controller 60 fully opens decompressor 6 to increase the opening of decompressor 6 greater than in the heating operation.

As the first mode continues, the quantity of heat stored in compressor 1 reduces, which lowers the temperature of compressor 1 and decreases the quantity of heat which the refrigerant can pick up from compressor 1. Consequently, the temperature of the refrigerant discharged from compressor 1 decreases. If the temperature of the refrigerant decreases to a reference temperature or less (e.g., 20 degrees Celsius or less), the refrigerant can barely recover the quantity of heat from compressor 1.

Consequently, the quantity of heat that is applied to the refrigerant by compressor 1 as the heat source for defrosting outdoor heat exchanger 7, needs to be increased. Thus, in the embodiment, the second mode is performed following the first mode. In the second mode, the opening of the decompressor is less than in the first mode and greater than in the heating operation. In the second mode, controller 60 sets the opening of decompressor 6 less than in the first mode, thereby increasing the difference in pressure between the refrigerant discharged from compressor 1 and the refrigerant drawn into compressor 1 to increase the compressor input (energy applied by the compressor to the refrigerant).

Figure 3:
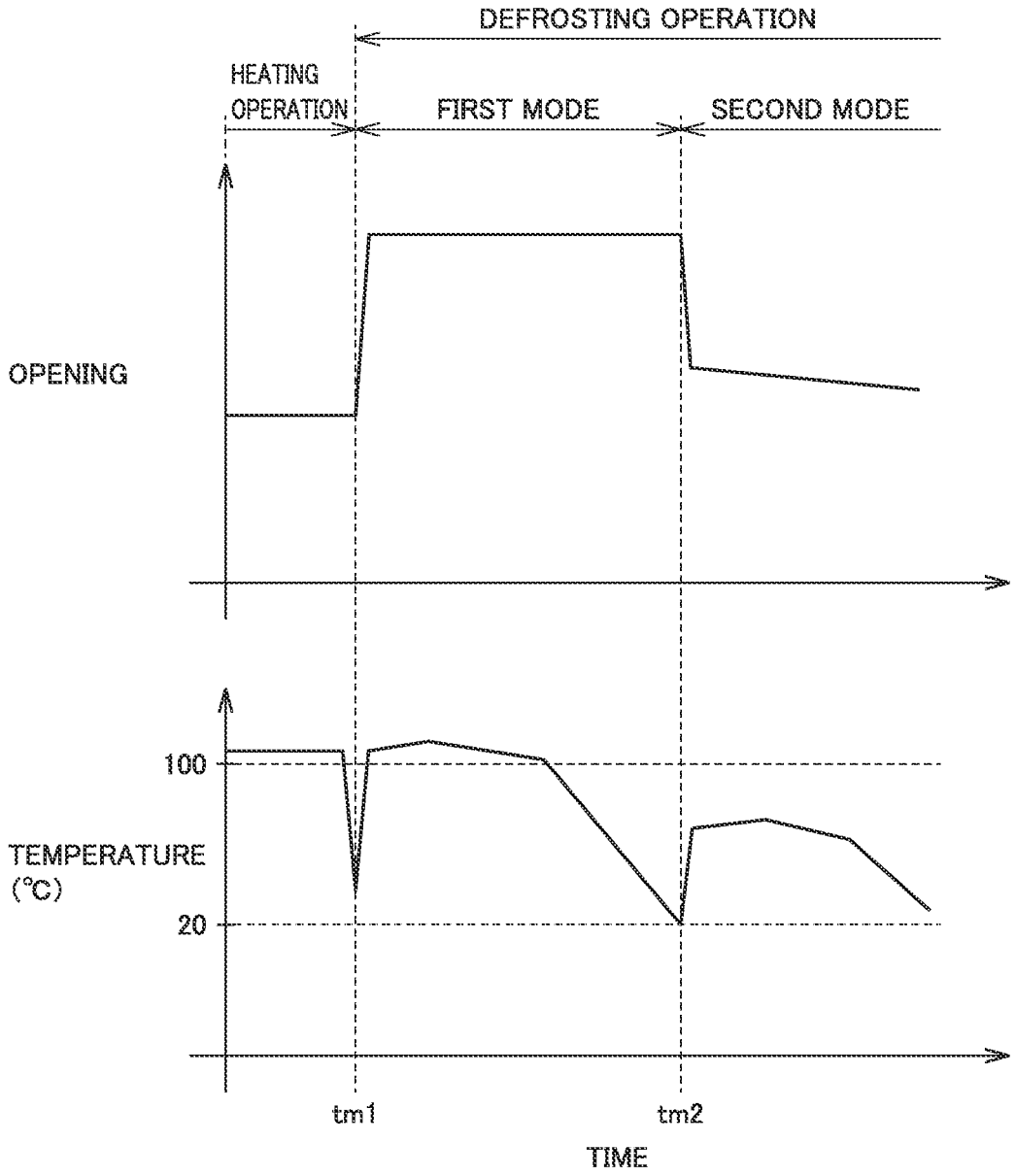
FIG. 3 is a time diagram showing changes in temperature of a refrigerant discharged from a compressor over time, and changes in an opening of decompressor over time.

FIG. 3 is a time diagram showing changes in temperature of the refrigerant discharged from compressor 1 over time, and changes in the opening of decompressor 6 over time. In FIG. 3, conditions for initiating the defrosting operation are met at time tm1 and conditions for switching the defrosting operation from the first mode to the second mode are met at time tm2. The conditions for switching the defrosting operation may be the temperature of the refrigerant discharged from compressor 1 as being less than or equal to the reference temperature (e.g., 20 degrees Celsius). A measurement by thermistor 31 may be used as the temperature of the refrigerant discharged from compressor 1.

Use of the temperature of the refrigerant discharged from compressor 1 as the conditions for switching the defrosting operation allows for determination with accuracy as to whether the heat capacity of compressor 1 has been used up, compared to using the temperature of the refrigerant drawn into compressor 1 as the conditions for switching the defrosting operation. Since the first mode is allowed to continue until the heat capacity of compressor 1 has been used up, the heat capacity of compressor 1 can be efficiently utilized as the heat source to defrost outdoor heat exchanger 7 in the defrosting operation.

The conditions for switching the defrosting operation from the first mode to the second mode may be superheat of the refrigerant, discharged from compressor 1, as being less than a reference value. The superheat is calculated from a measurement by pressure sensor 21 and a measurement by thermistor 31. Alternatively, the conditions for switching the defrosting operation from the first mode to the second mode may be the temperature or superheat of the refrigerant flowing between compressor 1 and decompressor 6 as being less than or greater than a reference value.

As shown in FIG. 3, the opening of decompressor 6 is greater in the first mode than in the heating operation. Since the flow path resistance of decompressor 6 is less in the first mode than in the heating operation, the circulation volume of the refrigerant increases, increasing the density of the refrigerant discharged from compressor 1 greater than in the heating operation. As a result, the temperature of the refrigerant discharged from compressor 1 is high for a while since the initiation of the first mode, as compared to the temperature at time tm1 at which the conditions for initiating the defrosting operation are met.

As the first mode continues, the quantities of heat stored in the piping member or compressor 1, etc. gradually decreases. As a result, the temperature of the refrigerant discharged from compressor 1 gradually decreases, down to 20 degrees Celsius or lower at time tm2. At time tm2, the defrosting operation is switched from the first mode to the second mode. The opening of decompressor 6 is reduced more in the second mode than in the first mode, which increases the compressor input greater in the second mode than in the first mode. As a result, the temperature of the refrigerant discharged from compressor 1 in the second mode is higher than the temperature at time tm2 at which the conditions for switching the defrosting operation are met.

In the first mode or the second mode, controller 60 determines that most of the frost formed on outdoor heat exchanger 7 has melted, and ends the defrosting operation if conditions for ending the defrosting operation are met. The conditions for ending the defrosting operation may be any insofar as it can be determined that most of the frost formed on outdoor heat exchanger 7 has melted. Examples of the conditions for ending the defrosting operation include the temperature (the measurement by thermistor 33) of the refrigerant flowing between outdoor heat exchanger 7 and decompressor 6 as being higher than or equal to a reference temperature (e.g., 5 degrees Celsius or higher).

Figure 4:
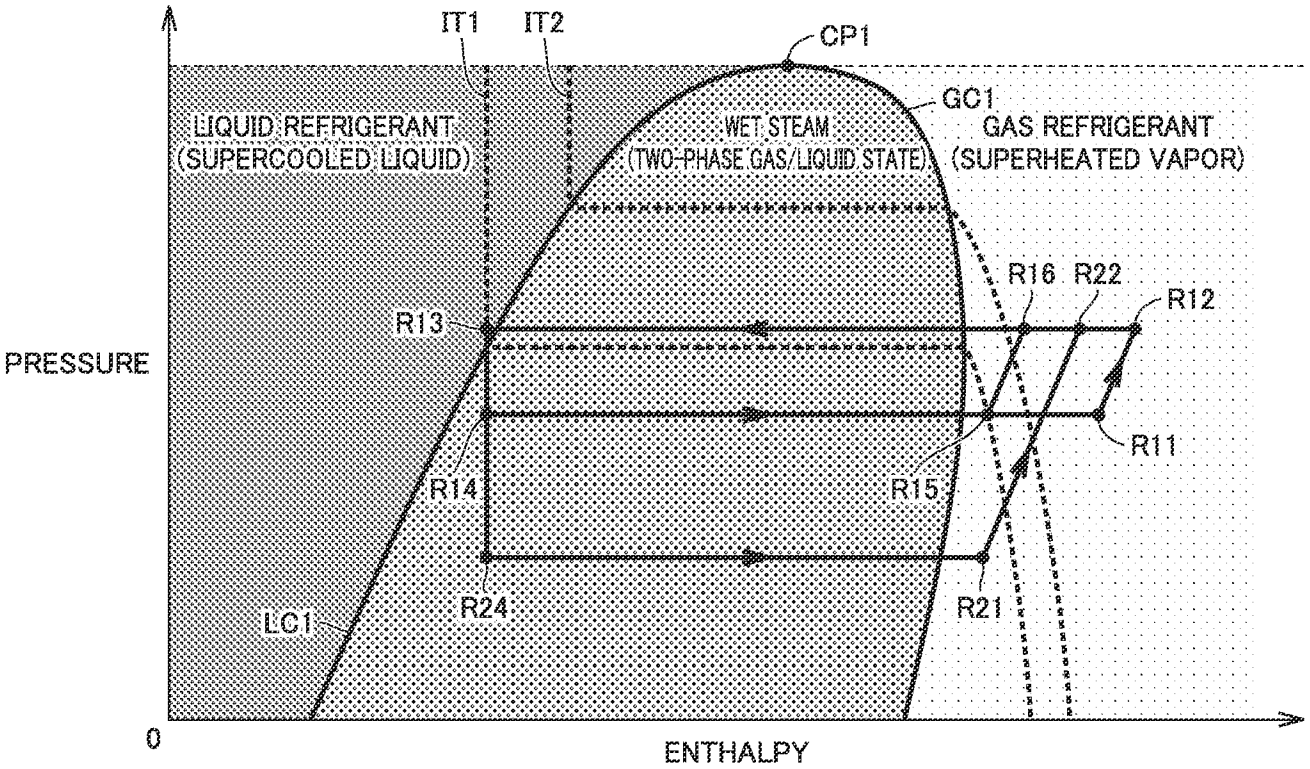
FIG. 4 is a Mollier diagram (a pressure-enthalpy diagram) showing the pressure versus the enthalpy of a refrigerant in the defrosting operation.

FIG. 4 is a Mollier diagram (a pressure-enthalpy diagram) showing the pressure versus enthalpy of the refrigerant in the defrosting operation. In FIG. 4, curve LC1 is a saturated liquid line of the refrigerant. Curve GC1 is a saturated vapor line of the refrigerant. Point CP1 is a critical point of the refrigerant. The critical point is a point which indicates the extreme of a range in which a phase change can occur between a liquid refrigerant and a gas refrigerant, and is a point of intersection of the saturated liquid line and the saturated vapor line.

As the pressure of the refrigerant increases greater than the pressure at the critical point, a phase change no longer occurs between the liquid refrigerant and the gas refrigerant. The refrigerant is a liquid in the region in which the enthalpy is below the saturated liquid line. The refrigerant is wet steam in the region between the saturated liquid line and the saturated vapor line. The refrigerant is a gas in the region in which the enthalpy is above the saturated vapor line. The same is true for FIG. 7. In FIG. 4, curves IT1 and IT2 are isotherms of the refrigerant that respectively correspond to zero degree Celsius and 40 degrees Celsius.

As shown in FIG. 4, in the first mode, the refrigerant circulates through refrigeration cycle device 100 in the order of points R11, R12, R13, and R14. The process of the state change from point R11 to point R12 represents a process of compression of the refrigerant by compressor 1. Point R11 represents a state of the refrigerant drawn into compressor 1. Point R12 represents a state of the refrigerant discharged from compressor 1. The pressure and enthalpy of the refrigerant in the state at point R12 is greater than the pressure and enthalpy of the refrigerant in the state at point R11, due to the compressor input.

The process of the state change from point R12 to point R13 represents a process of condensation of the refrigerant in outdoor heat exchanger 7. The saturation temperature of the refrigerant in the process of condensation in the defrosting operation is zero degree Celsius, which is the ice melting temperature, or higher by a few degrees than zero degree Celsius. The process of the state change from point R13 to point R14 represents a process of decompression of the refrigerant by decompressor 6. Point R14 represents a state of the refrigerant leaving the decompressor 6. The process of the state change from point R14 to point R11 represents a process of evaporation of the refrigerant in indoor heat exchanger 4.

As the first mode continues, the temperature of the refrigerant drawn into compressor 1 and the temperature of the refrigerant discharged from compressor 1 both decrease, and thus the state of the refrigerant at point R11 and the state of the refrigerant at point R12 change toward the state of the refrigerant at point R15 and the state of the refrigerant at point R16, respectively.

If the conditions are met for switching the defrosting operation from the first mode to the second mode, the opening of decompressor 6 is reduced in the second mode. The flow path resistance of decompressor 6 increases and thus the density of the refrigerant leaving the decompressor 6 decreases. The pressure of the refrigerant leaving the decompressor 6 decreases and thus the state of the refrigerant at point R14 changes to the state of the refrigerant at point R24. The pressure of the refrigerant drawn into compressor 1 also decreases, and thus the state of the refrigerant changes from the state at point R15 to the state at point R21.

In the second mode, the refrigerant circulates through refrigeration cycle device 100 in the order of the points R21, R22, R13, and R24. The enthalpy of the refrigerant in the state at point R22 is higher than the enthalpy at point R16 in the first mode, due to an increase in the compressor input. In other words, the quantity of heat of the refrigerant in the state at point R22 is greater than the quantity of heat of the refrigerant in the state at point R16. Accordingly, frost formed on outdoor heat exchanger 7 melts more quickly by defrosting the outdoor heat exchanger 7 using the quantity of heat of the refrigerant in the state at point R22 than by continuing the first mode and defrosting the outdoor heat exchanger 7 using the quantity of heat of the refrigerant in the state at point R16. Consequently, the defrosting of outdoor heat exchanger 7 can be completed in a shorter time.

Refrigeration cycle device 100 performs the second mode in which the compressor input is greater than in the first mode, if outdoor heat exchanger 7 is defrosted incompletely in the first mode although the quantity of heat of the piping member and the quantity of heat of the component of refrigeration cycle device 100, such as compressor 1, have been used up. As such, the second mode is performed after the first mode, thereby speeding up the melting of the frost formed on outdoor heat exchanger 7. Consequently, the time required to defrost the outdoor heat exchanger 7 is further reduced.

Figure 5:
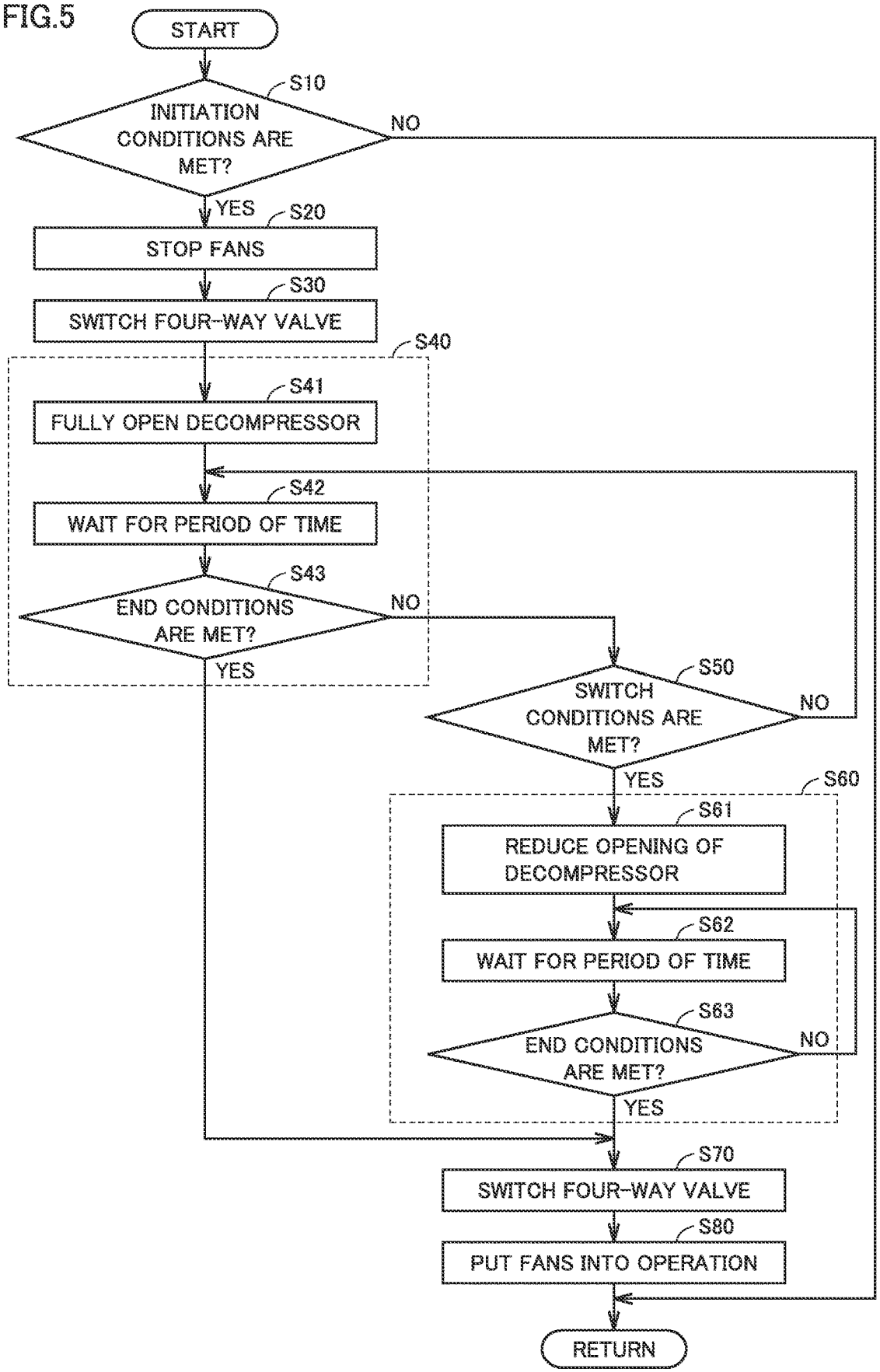
FIG. 5 is a flowchart showing processing performed by a controller in the defrosting operation.

FIG. 5 is a flowchart showing processing that is performed by controller 60 in the defrosting operation. The processing shown in FIG. 5 is called by a main routine (not shown) at regular intervals. In the following, the steps will be referred to simply as S.

As shown in FIG. 5, at S10, controller 60 determines whether the conditions for initiating the defrosting operation are met. If the conditions for initiating the defrosting operation are not met (NO at S10), controller 60 returns the process to the main routine. If the conditions for initiating the defrosting operation are met (YES at S10), controller 60 passes the process to S20.

Controller 60 stops outdoor fan 11 and indoor fan 12 at S20, and passes the process to S30. Controller 60 switches four-way valve 2 to change the direction of circulation of the refrigerant to a direction opposite the direction of circulation for the heating operation at S30, and passes the process to S40.

Step S40 includes S41, S42, and S43 which are performed in the first mode. Controller 60 sets the defrosting operation to the first mode in which decompressor 6 is fully opened, and passes the process to S42. Controller 60 waits for a period of time at S42, and then passes the process to S43. While controller 60 is waiting for a period of time in the first mode, a high-temperature, high-pressure gas refrigerant, discharged from compressor 1 and having an increased circulation volume, flows into the outdoor heat exchanger 7 having frost formed thereon, and melts the frost.

Controller 60 determines whether the conditions for ending the defrosting operation are met at S43. If the conditions for ending the defrosting operation are met (YES at S43), controller 60 passes the process to S70. If the conditions for ending the defrosting operation are not met (NO at S43), controller 60 passes the process to S50.

At S50, controller 60 determines whether the conditions are met for switching the defrosting operation from the first mode to the second mode. If the conditions for switching the defrosting operation are not met (NO at S50), controller 60 passes the process back to S42. If the conditions for switching the defrosting operation are met (YES at S50), controller 60 passes the process to S60.

Step S60 includes S61, S62, and S63 which are performed in the second mode. Controller 60 switches, at S61, the defrosting operation to the second mode in which the opening of decompressor 6 is reduced greater than in the first mode, and passes the process to S62. Controller 60 waits for a period of time at S62, and then passes the process to S63. While controller 60 is waiting for a period of time in the second mode, a high-temperature, high-pressure gas refrigerant, discharged from compressor 1 and having the compressor input increased greater than in the first mode, flows into outdoor heat exchanger 7 having frost formed thereon, and speeds up the melting of the frost.

At S63, controller 60 determines whether the conditions for ending the defrosting operation are met. If the conditions for ending the defrosting operation are not met (NO at S63), controller 60 passes the process back to S62. If the conditions for ending the defrosting operation are met (YES at S63), controller 60 passes the process to S70.

Controller 60 switches four-way valve 2 to return the direction of circulation of the refrigerant back to the direction of circulation for the heating operation at S70, and passes the process to S80. Controller 60 puts outdoor fan 11 and indoor fan 12 back into operation at S80, and returns the process to the main routine.

After the defrosting operation ends, typically, the heating operation resumes. Controller 60 switches four-way valve 2 to switch the direction of circulation of the refrigerant and causes outdoor fan 11 and indoor fan 12 to operate, thereby operating compressor 1. In the defrosting operation, the temperature of indoor heat exchanger 4 is reduced. Thus, if cold air delivered into the room is not desirable from the standpoint of user comfort, the operation of indoor fan 12 may be initiated later in time than the initiation of the operation of compressor 1.

In order to increase the circulation volume of the refrigerant, preferably, a greater density of the refrigerant is drawn into compressor 1. The density of the refrigerant drawn into compressor 1 is maximum when the saturation temperature is zero degree Celsius where there is no pressure loss in decompressor 6. However, for cost or installation space reasons, it is often difficult to use a large-diameter electronic decompressor as the decompressor 6 for the sake of reduction of the pressure loss in decompressor 6.

A cost considerably increases if decompressor 6 is configured, for the sake of reduction of the pressure loss in decompressor 6, such that multiple on-off valves are connected in parallel. Thus, when refrigeration cycle device 100 is in the first mode, controller 60 selects decompressor 6 that allows the saturation temperature of the refrigerant drawn into compressor 1 to be higher than or equal to −10 degrees Celsius and less than or equal to zero degree Celsius, and controls the opening of decompressor 6, the saturation temperature being calculated from a measurement by pressure sensor 22.

Figure 6:
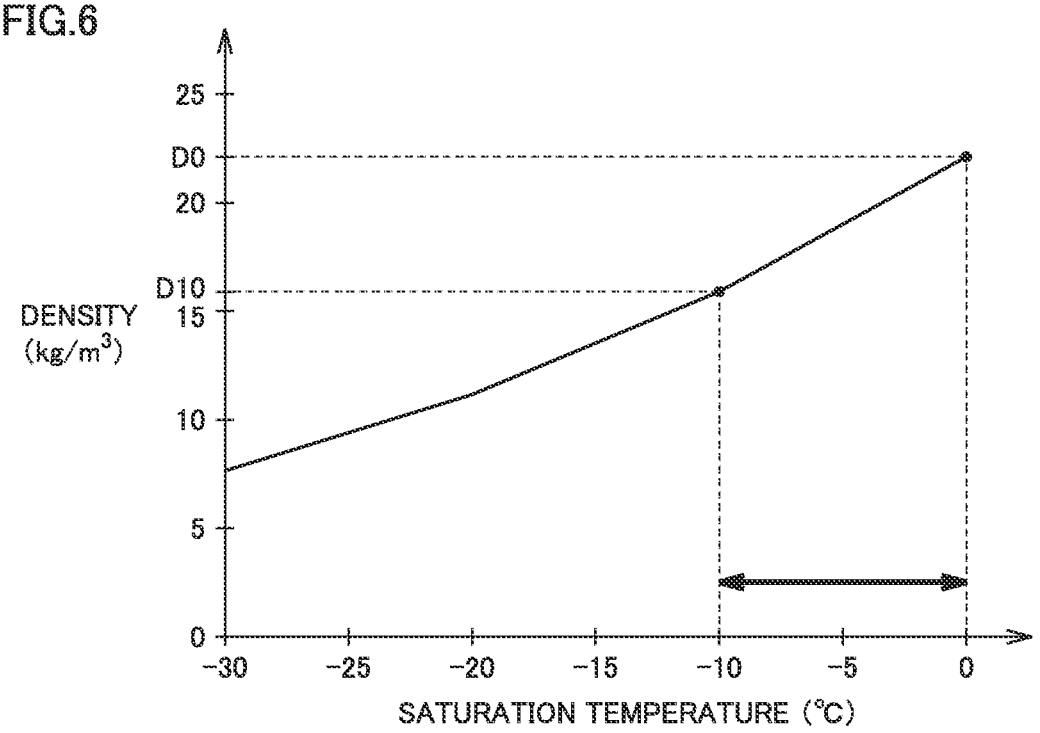
FIG. 6 is a graph showing the saturation temperature versus the density of a refrigerant drawn into the compressor.

FIG. 6 is a graph showing the saturation temperature versus density of the refrigerant drawn into compressor 1. In FIG. 6, density D0 is a density of the refrigerant when the saturation temperature is zero degree Celsius. Density D10 is a density of the refrigerant when the saturation temperature is −10 degrees Celsius. Density D10 has a value that is about 70% of density D0. As shown in FIG. 6, when the saturation temperature of the refrigerant drawn into compressor 1 is higher than or equal to −10 degrees Celsius and less than or equal to zero degree Celsius, the density of the refrigerant drawn into compressor 1 is greater than or equal to D10 and less than or equal to D0. In other words, a decline of the density of the refrigerant drawn into compressor 1 can be reduced to be within about 30% from the maximum value. As a result, an increase in amount of time required for the first mode can be reduced to be within about 30% from the minimum amount of time.

Figure 7:
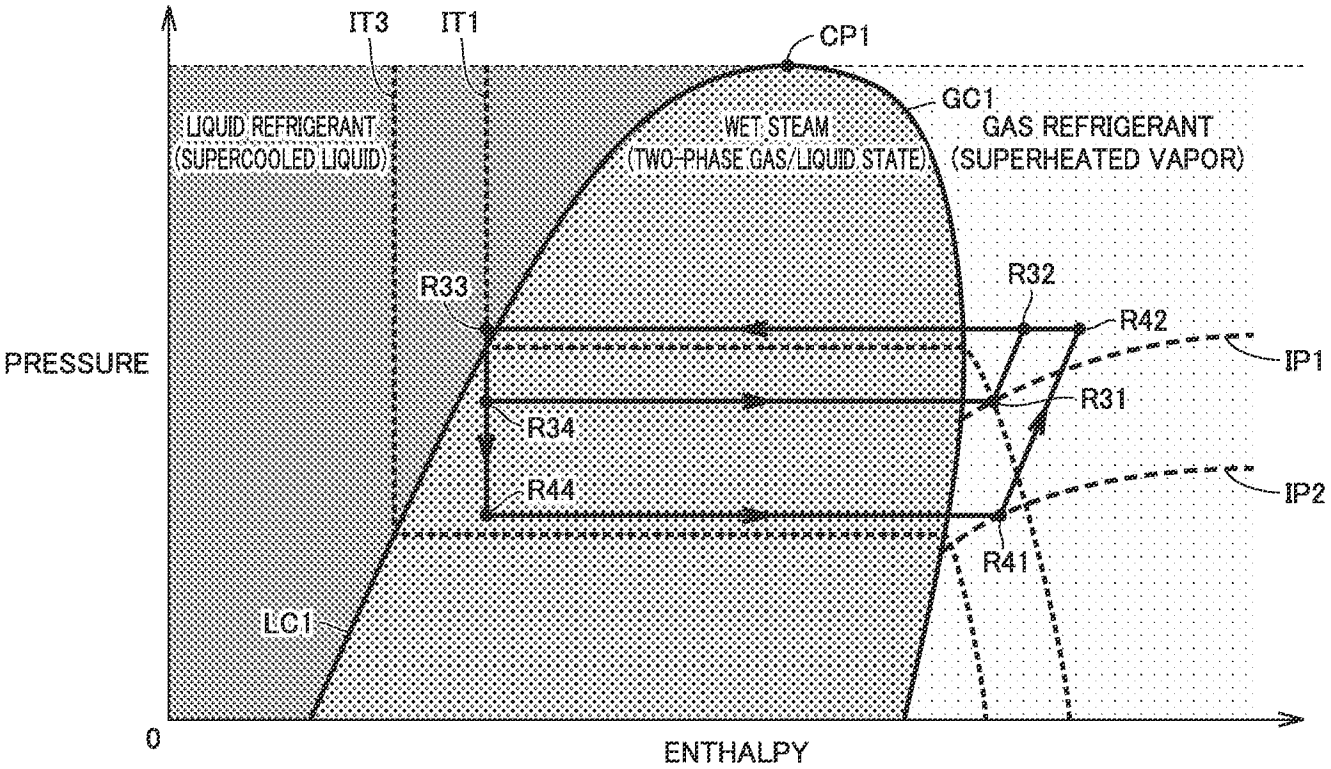
FIG. 7 is a Mollier diagram for illustrating the relationship between compressor input, the density of a refrigerant, and an enthalpy difference.

FIG. 7 is a Mollier diagram for illustrating the relationship between the compressor input, the density of the refrigerant, and the enthalpy difference. In FIG. 7, curves IT1 and IT3 are isotherms of the refrigerant that respectively correspond to zero degree Celsius and −40 degrees Celsius. Curves IP1 and IP2 are isopycnics of the refrigerant that respectively correspond to densities D1 and D2 (D2<D1). In the following, a comparison is made between a cycle of circulation of the refrigerant in the order of points R31, R32, R33, and R34 and a cycle of circulation of the refrigerant in the order of points R41, R42, R33, and R34. The density of the refrigerant in the state at point R31 is D1, and the density of the refrigerant at point R41 is D2.

The saturation temperature of the refrigerant drawn into compressor 1 in the state at point R41 is lower than that in the state at point R31. The enthalpy difference between the refrigerant discharged from compressor 1 and the refrigerant drawn into compressor 1 is greater between points R41 and R42 than between points R31 and R32. For the density of the refrigerant drawn into compressor 1, density D2 of the refrigerant in the state at point R41 is less than density D1 of the refrigerant in the state at point R31.

In other words, the lower the saturation temperature of the refrigerant drawn into compressor 1 is, the greater the enthalpy difference between the refrigerant discharged from compressor 1 and the refrigerant drawn into compressor 1 and the less the density of the refrigerant drawn into compressor 1 is. The compressor input is in proportion to a product of the density of the refrigerant drawn into compressor 1 and the enthalpy difference between the refrigerant discharged from compressor 1 and the refrigerant drawn into compressor 1. If the density of the refrigerant drawn into compressor 1 is increased by increasing the saturation temperature of the refrigerant drawn into compressor 1, the enthalpy difference between the refrigerant discharged from compressor 1 and the refrigerant drawn into compressor 1 decreases.

In contrast, if the enthalpy difference between the refrigerant discharged from compressor 1 and the refrigerant drawn into compressor 1 is increased by lowering the saturation temperature of the refrigerant drawn into compressor 1, the density of the refrigerant drawn into compressor 1 decreases. The compressor input is at its maximum when the saturation temperature of the refrigerant drawn into compressor 1 is around −30 degrees Celsius.

Figure 8:
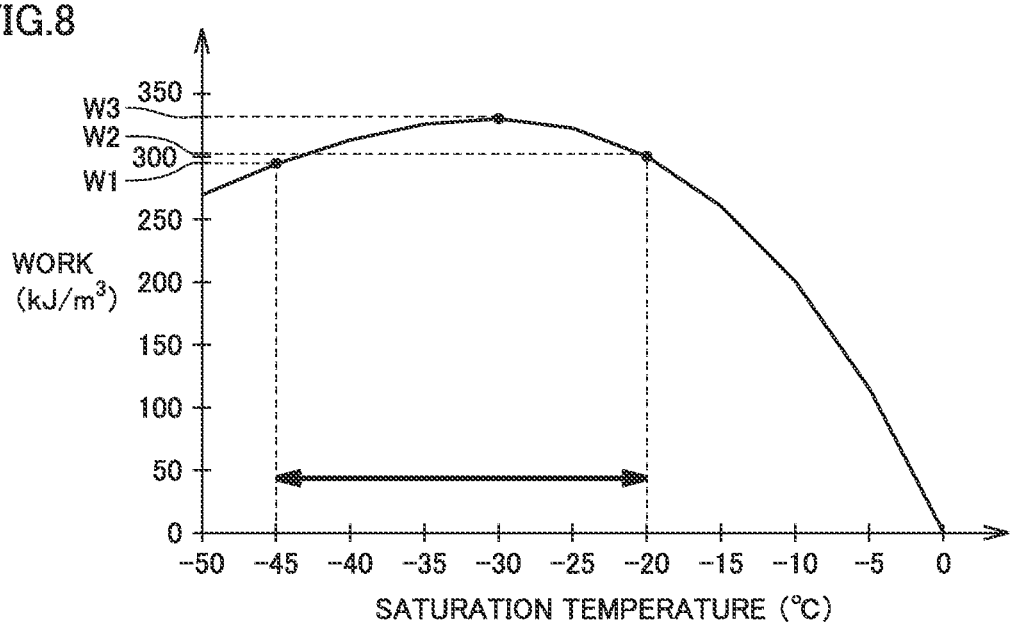
FIG. 8 is a graph showing a saturation temperature of a refrigerant drawn into the compressor versus compressor input.

FIG. 8 is a graph showing the saturation temperature of the refrigerant drawn into compressor 1 versus the compressor input. In FIG. 8, work W1 indicates the compressor input when the saturation temperature is −45 degrees Celsius. Work W2 (<W1) indicates the compressor input when the saturation temperature is −20 degrees Celsius. Work W3 indicates the maximum value of the compressor input. Works W1 and W2 have values that are about 90% of work W3.

As shown in FIG. 8, when the saturation temperature of the refrigerant drawn into compressor 1 is higher than or equal to −45 degrees Celsius and lower than or equal to −20 degrees Celsius, the compressor input is greater than or equal to W1 and less than or equal to W3. In other words, a decline of the compressor input can be reduced to be within about 10% from the maximum value. Thus, in the second mode, the opening of decompressor 6 is controlled so that the saturation temperature of the refrigerant drawn into compressor 1, calculated from a measurement by pressure sensor 22, is higher than or equal to −45 degrees Celsius and lower than or equal to −20 degrees Celsius. The decline of the compressor input can be reduced to be within about 10% from maximum value W3. As a result, an increase in amount of time required for the second mode can be reduced to be within about 10% from the minimum amount of time.

As described above, according to the refrigeration cycle device of the embodiment, the time required to defrost the heat exchanger can be reduced.

The presently disclosed embodiment should be considered in all aspects as illustrative and not restrictive. The scope of the present invention is indicated by the appended claims, rather than by the description above, and all changes that come within the scope of the claims and the meaning and range of equivalency of the claims are intended to be embraced within their scope.

REFERENCE SIGNS LIST

1 compressor; 2 four-way valve; 3, 5 connecting pipe; 4, 7 heat exchanger; 6 decompressor; 11 outdoor fan; 12 indoor fan; 21, 22 pressure sensor; 31 to 33 thermistor; 50 outdoor unit; 51 indoor unit; 60 controller; and 100 refrigeration cycle device.

The invention claimed is:

1. A refrigeration cycle device which performs a heating operation and a defrosting operation, in which a refrigerant circulates in opposite directions in the defrosting operation and the heating operation, the refrigeration cycle device comprising:

a compressor;

a first heat exchanger and a second heat exchanger;

a decompressor;

a flow path switch configured to switch directions in which the refrigerant circulates; and a controller configured to control the flow path switch and the decompressor to switch operations of the refrigeration cycle device, wherein the refrigerant in the heating operation circulates in an order of the compressor, the first heat exchanger, the decompressor, and the second heat exchanger, and the refrigerant in the defrosting operation circulates in an order of the compressor, the second heat exchanger, the decompressor, and the first heat exchanger, the defrosting operation includes a first mode and a second mode, an opening of the decompressor is greater in the first mode than in the heating operation, the opening of the decompressor is less in the second mode than in the first mode, and the controller is configured to:

switch the refrigeration cycle device from the heating operation to the first mode when a condition for initiating the defrosting operation is met; and switch the refrigeration cycle device from the first mode to the second mode when a condition for ending the defrosting operation is not met and a temperature of the refrigerant flowing between the compressor and the second heat exchanger is lower than a reference value.

2. The refrigeration cycle device according to claim 1, wherein the decompressor is fully open in the first mode.

3. The refrigeration cycle device according to claim 1, wherein a saturation temperature of the refrigerant flowing between the first heat exchanger and the compressor in the first mode is greater than or equal to −10 degrees Celsius and less than or equal to zero degree Celsius.

4. The refrigeration cycle device according to claim 1, wherein a saturation temperature of the refrigerant flowing between the first heat exchanger and the compressor in the second mode is greater than or equal to −45 degrees Celsius and less than or equal to −20 degrees Celsius.

* * * * *